US006067827A

United States Patent [19]

Haseley et al.

[11] Patent Number: 6,067,827

[45] **Date of Patent: *May 30, 2000**

[54] LOCK CONSTRUCTION

[75] Inventors: Daryl R. Haseley, Orchard Park; Jeffery R. Sullivan; Thomas R. Lanham, both of Boston, all of N.Y.

[73] Assignee: McGard, Inc., Orchard Park, N.Y.

[ * ] Notice: This patent is subject to a terminal disclaimer.

[21] Appl. No.: 09/190,490

[22] Filed: Nov. 12, 1998

Related U.S. Application Data

[63] Continuation-in-part of application No. 09/072,020, May 4, 1998, Pat. No. 6,018,969.

[51] Int. Cl.[7] ..... E05B 9/08

[52] U.S. Cl. ..... 70/370; 70/161; 70/63; 70/461; 292/DIG. 60

[58] Field of Search ..... 70/370, 159, 160, 70/161, 162, 163, 164, 165, 166, 167, 168, 169, 229, 79, 63, 135, 139, 140, 461, 403, 404, 389, DIG. 62, 379 R, 379 A, 380, DIG. 39, DIG. 13; 411/150, 155, 149, 229, 231, 239, 366.1, 367; 292/DIG. 60, 202, 203, 204, 210

[56] References Cited

U.S. PATENT DOCUMENTS

| | | | |
|---|---|---|---|
| 1,458,520 | 6/1923 | Castell | 70/DIG. 13 |
| 2,453,492 | 11/1948 | Carter | 24/71 |
| 2,693,100 | 11/1954 | Wiegel | 70/389 |
| 3,089,330 | 5/1963 | Kerr | 70/140 |
| 3,418,833 | 12/1968 | Kerr | 70/389 |
| 3,519,979 | 7/1970 | Bodenstein | 70/404 |
| 4,143,530 | 3/1979 | Murtezov et al. | 70/165 |
| 4,342,208 | 8/1982 | Evans | 70/165 |
| 4,571,133 | 2/1986 | Lindow | 411/11 |
| 4,627,249 | 12/1986 | Dumortier | 70/139 |
| 4,823,571 | 4/1989 | O'Gara | 70/139 |
| 4,878,367 | 11/1989 | Bisbing | 70/491 |
| 5,119,653 | 6/1992 | Mazzotta | 70/58 |
| 5,412,960 | 5/1995 | James et al. | 70/63 |
| 5,413,392 | 5/1995 | Schlack et al. | 292/204 |
| 5,533,849 | 7/1996 | Burdick | 411/120 |
| 5,651,280 | 7/1997 | Park | 70/472 |
| 5,730,014 | 3/1998 | Berger et al. | 70/422 |
| 5,737,950 | 4/1998 | Yun-Bin | 70/379 R |
| 5,775,145 | 7/1998 | Kasper | 70/367 |

FOREIGN PATENT DOCUMENTS

| | | | |
|---|---|---|---|
| 1167899 | 12/1958 | France | 411/150 |

*Primary Examiner*—B. Dayoan
*Assistant Examiner*—Clifford B Vaterlaus
*Attorney, Agent, or Firm*—Joseph P. Gastel

[57] ABSTRACT

A lock including a lock housing, a lock bolt rotatably mounted in the lock housing, an undulating end on the lock housing, a torque plate mounted on the lock bolt for rotation therewith, an undulating face on the torque plate, and a spring mounted on the lock bolt and biasing the torque plate into engagement with the undulating end of the lock housing with the undulating face of the torque plate in meshing engagement with the undulating end of the lock housing. A bracket is mounted on the lock housing, first wings on the bracket, and a key having second wings for engagement with the first wings when the lock is in an unlocked condition.

36 Claims, 7 Drawing Sheets

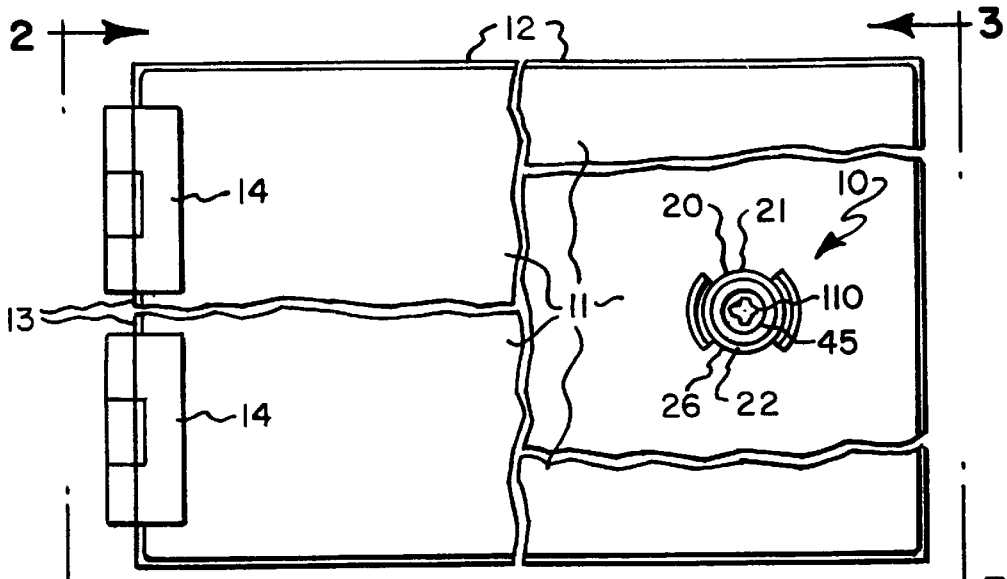
Fig. 1.
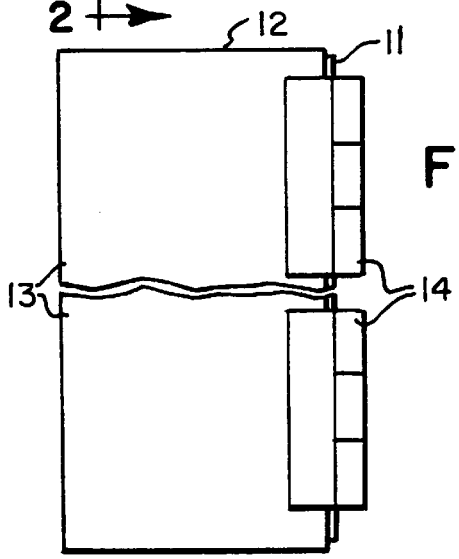
Fig. 2.
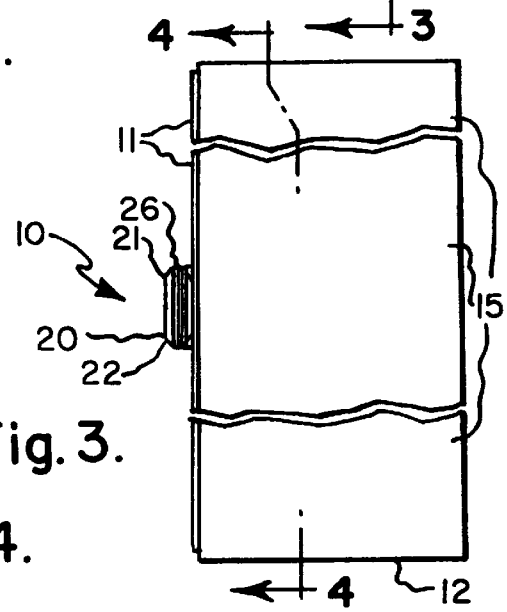
Fig. 3.
Fig. 4.
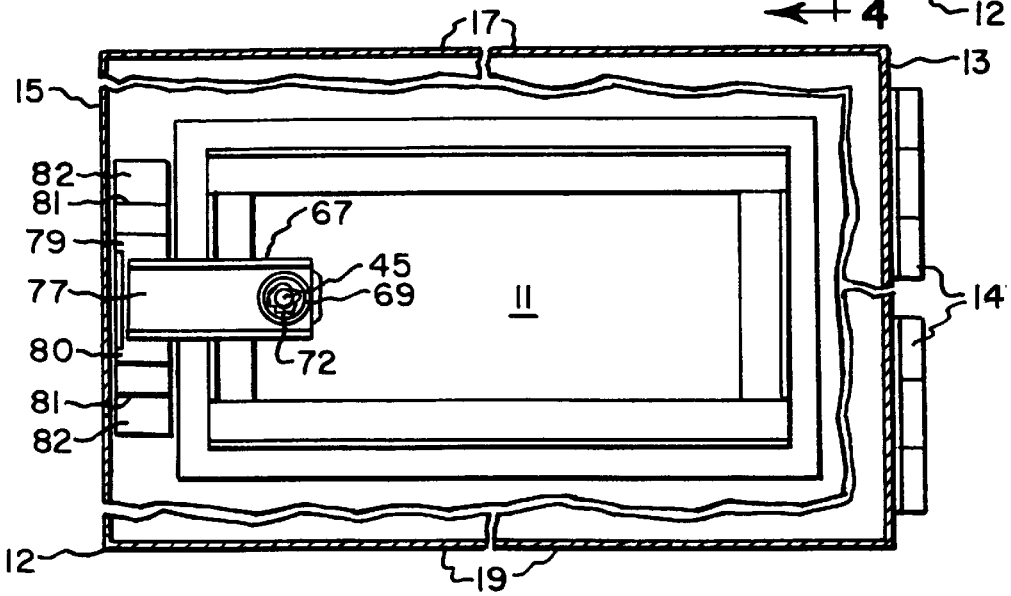

Fig. 18.
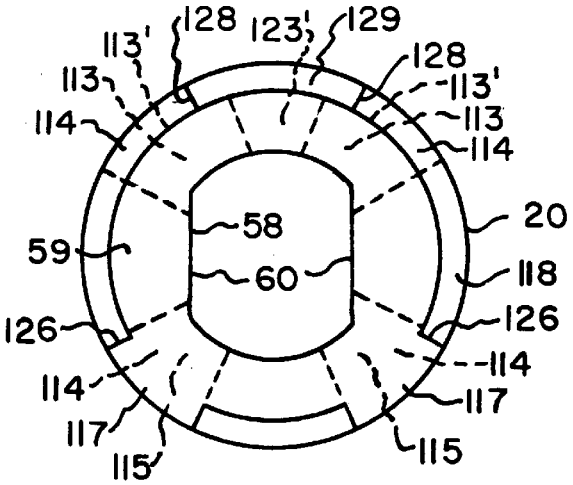
Fig. 20.
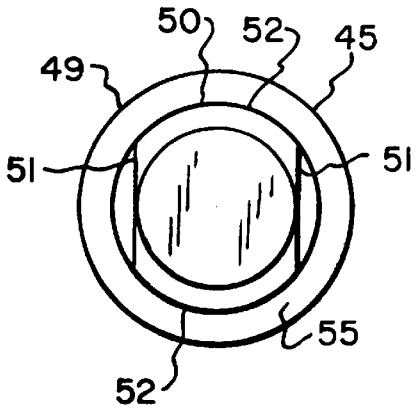
Fig. 19.
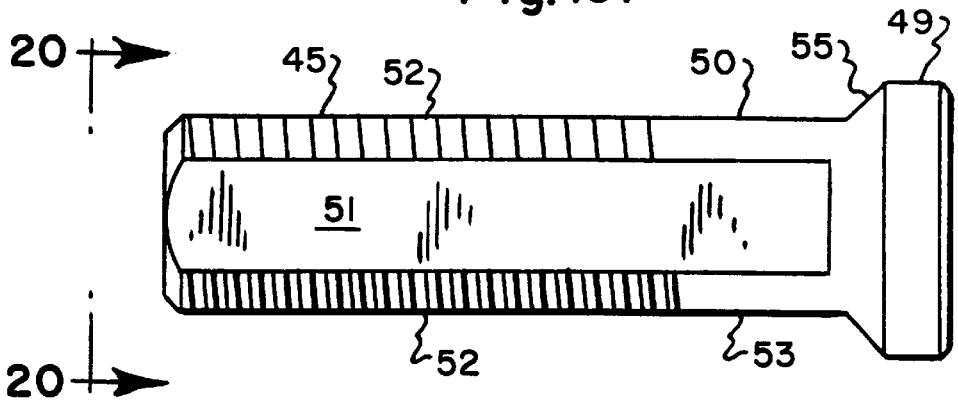
Fig. 7A.
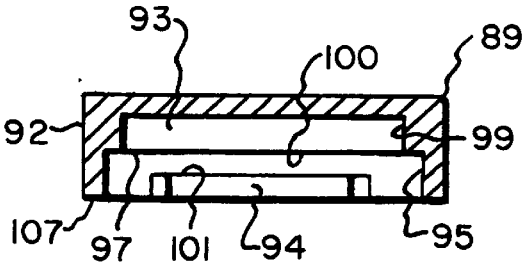
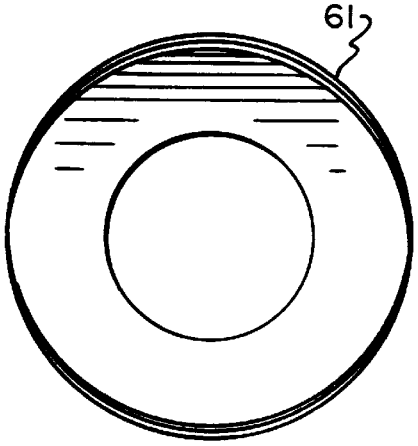
Fig. 21.

Fig. 8.
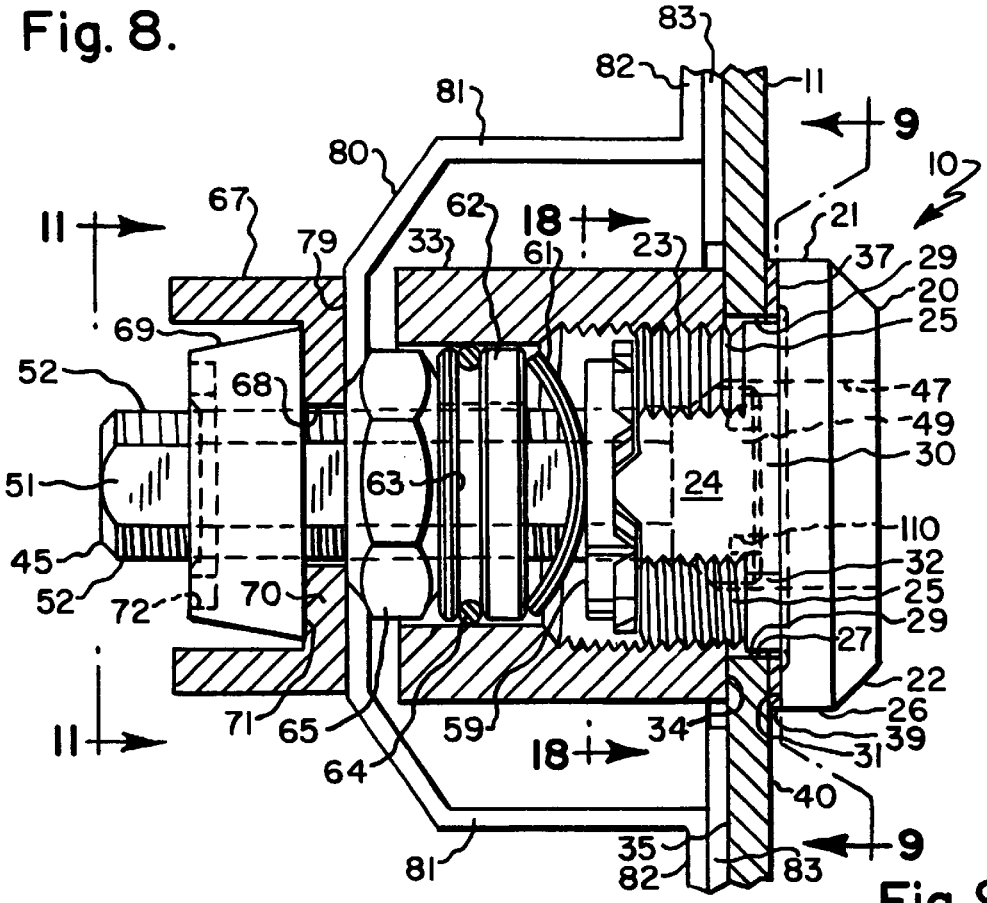
Fig. 9.
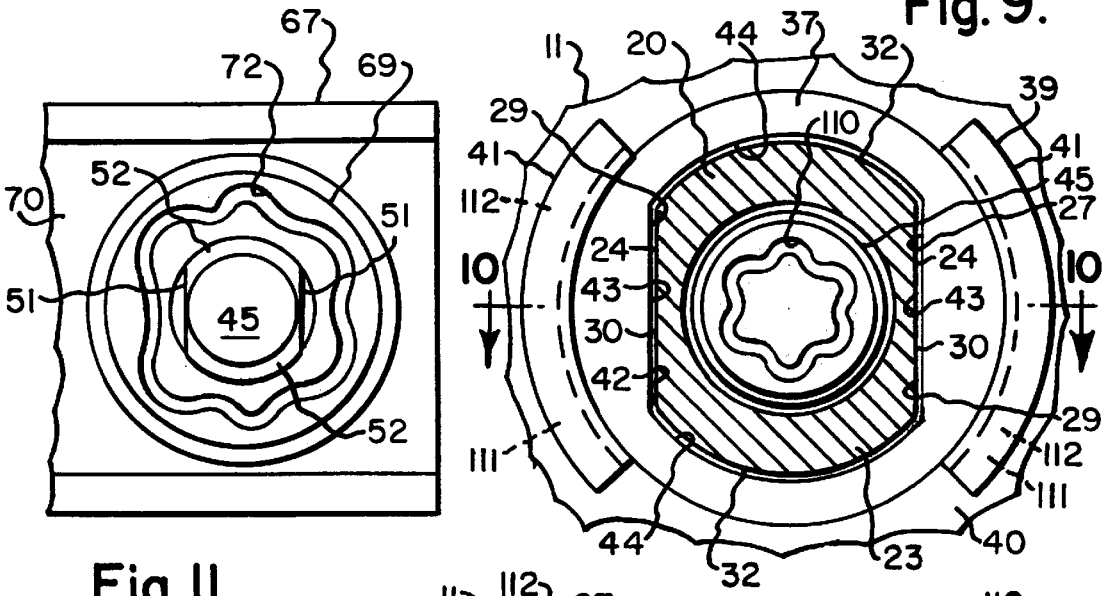
Fig. 11.
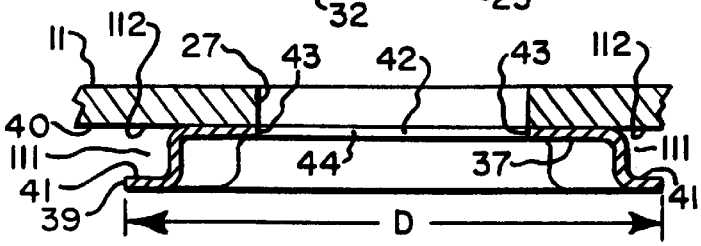
Fig. 10.

Fig. 15.
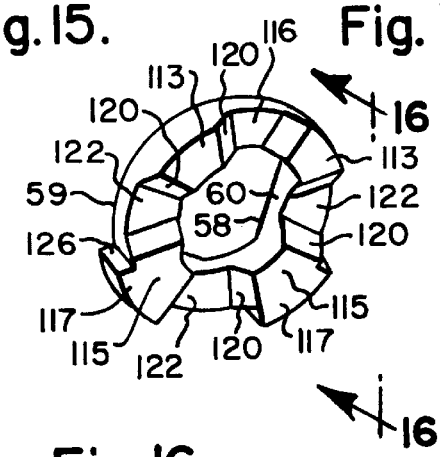
Fig. 12.
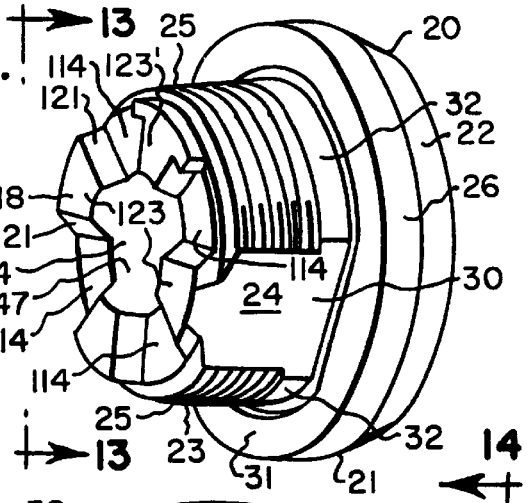
Fig. 16.
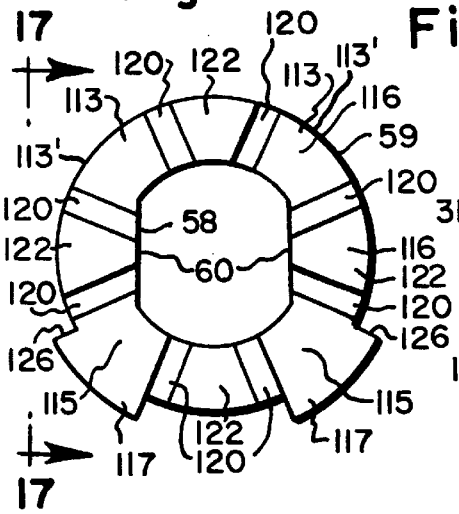
Fig. 13.
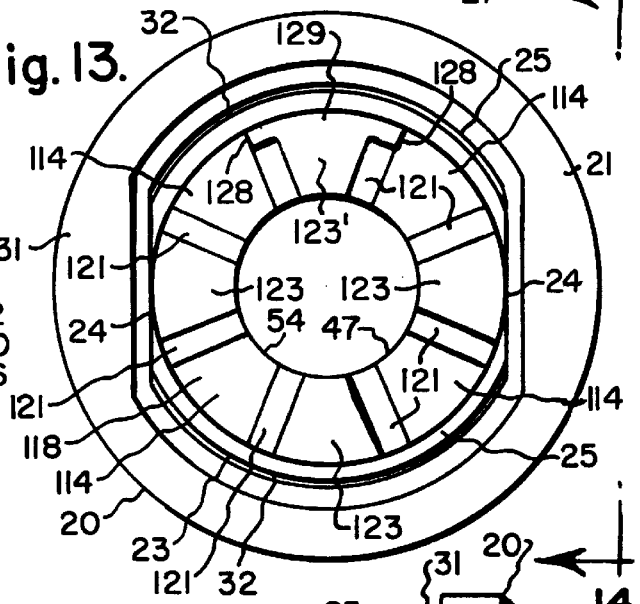
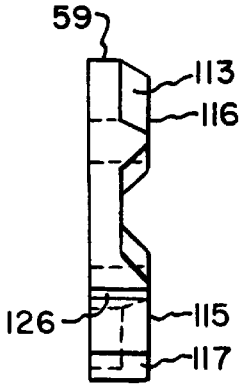
Fig. 17.
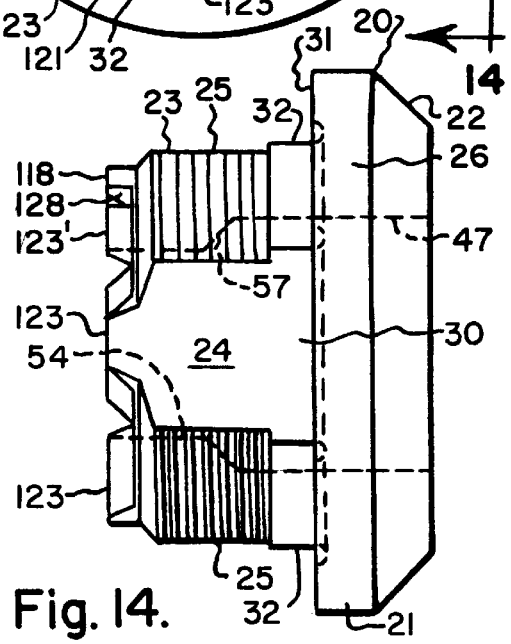
Fig. 14.

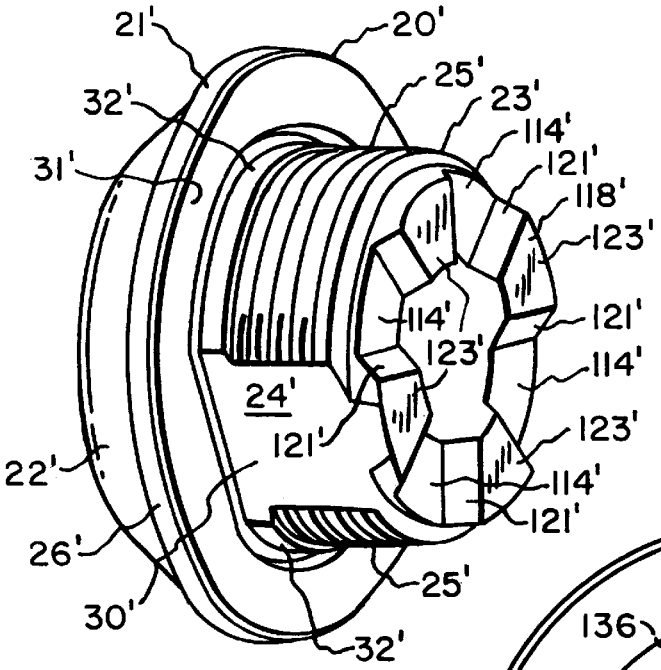
Fig. 22.
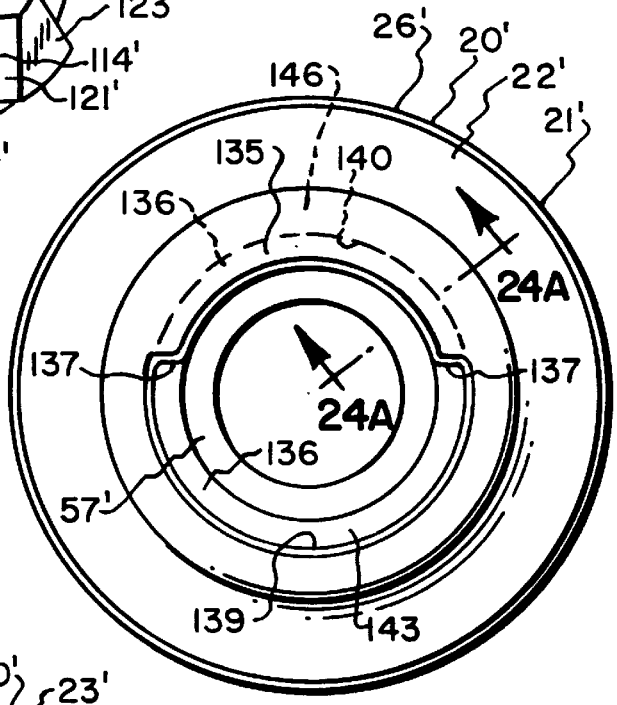
Fig. 24.
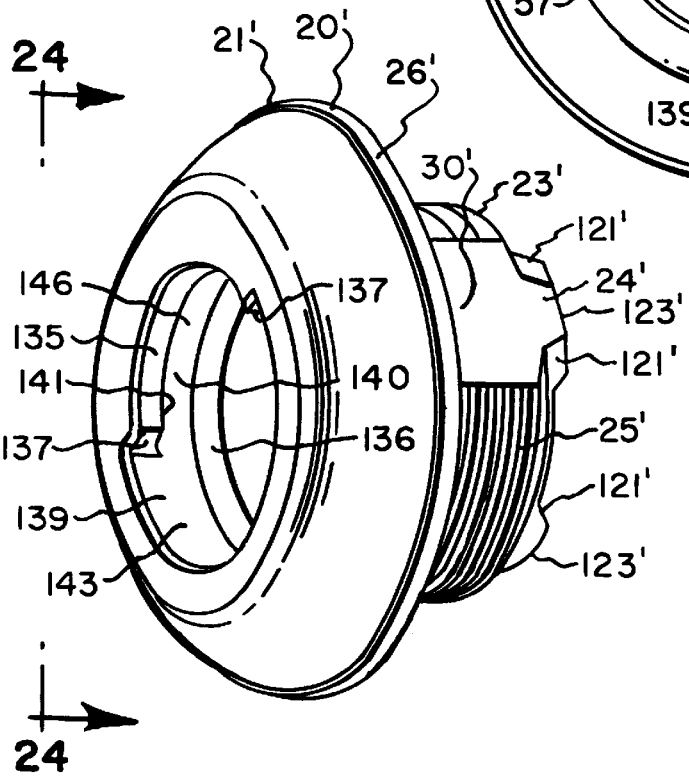
Fig. 23.
Fig. 24A.
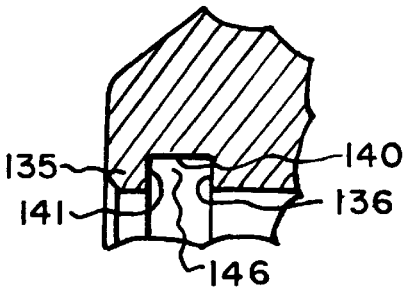

Fig. 25.
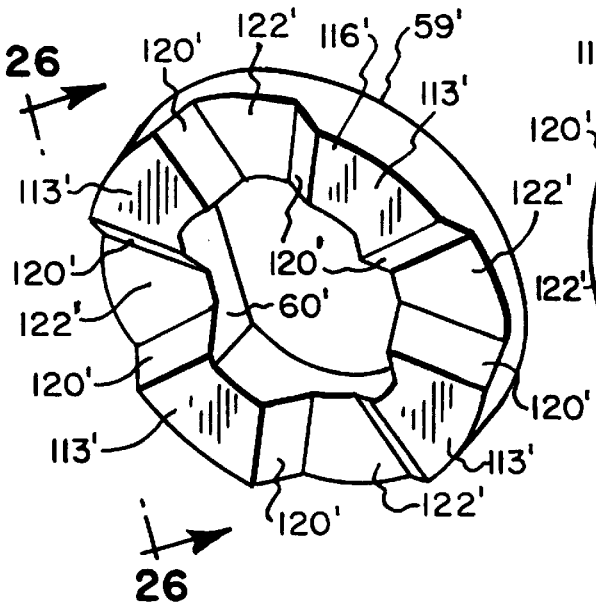
Fig. 26.
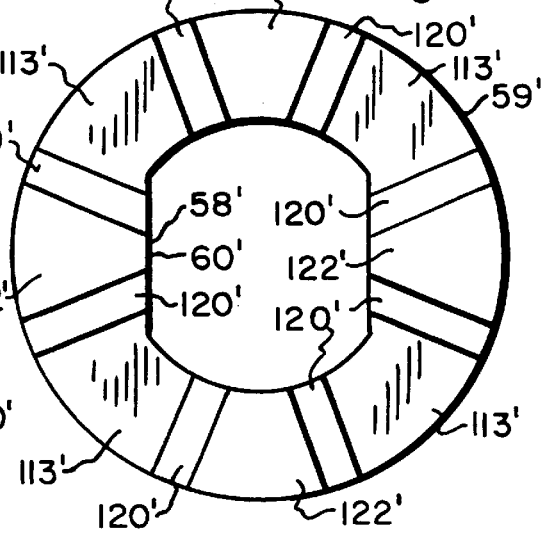
Fig. 28.
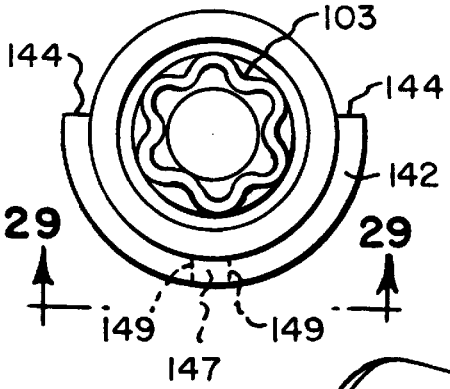
Fig. 29.
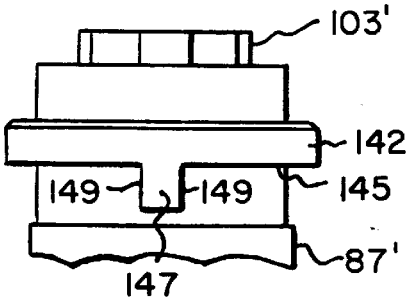
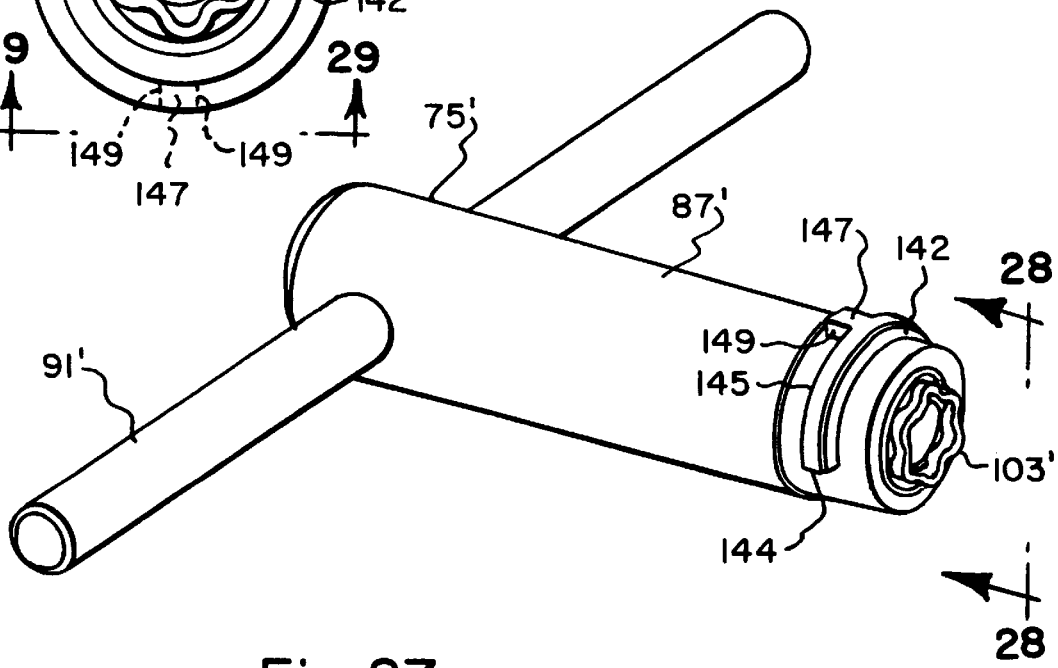
Fig. 27.

LOCK CONSTRUCTION

CROSS-REFERENCE TO RELATED APPLICATIONS

The present application is a continuation-in-part of application Ser. No. 09/072,020, filed May 4, 1998, now U.S. Pat. No. 6,018,969.

STATEMENT REGARDING FEDERALLY SPONSORED RESEARCH OR DEVELOPMENT

Not Applicable.

BACKGROUND OF THE INVENTION

The present invention relates to an improved lock construction for use on cabinet doors and the like.

By way of background, there are cabinets in use which house electrical circuitry. These cabinets have doors which require reliable locks which are capable of preventing unauthorized access. Furthermore, the cabinet lock should have a construction which requires the lock to be in a locked condition if the key for the lock is removed. Also, it is desirable that the lock require a substantial force to move it between locked and unlocked positions.

BRIEF SUMMARY OF THE INVENTION

It is one object of the present invention to provide an improved lock which requires a substantial torque to move it between locked and unlocked positions, thereby lessening the chance that the lock can be turned with other than an authorized key.

Another object of the present invention is to provide an improved lock in which the substantial torque required to move it between locked and unlocked positions is adjustable to meet different requirements.

Yet another object of the present invention is to provide an improved lock which cannot be disassembled except by the use of an authorized key.

A further object of the present invention is to provide an improved lock having a key construction which cannot be removed from mating engagement with the lock unless the lock is in a locking condition.

Yet another object of the present invention is to provide an improved lock having structure which restricts relative motion between its parts to positively retain it in either a locked or unlocked condition. Other objects and attendant advantages of the present invention will readily be perceived hereafter.

The present invention relates to a lock comprising a lock housing, a lock bolt rotatably mounted in said lock housing, a member mounted on said lock bolt for rotation therewith, interfitting surfaces between said member and said lock housing retaining said lock bolt in a locking position and an unlocking position, and a spring biasing said member into interfitting engagement with said lock housing.

The present invention also relates to a lock as set forth in the preceding paragraph including means for limiting rotational movement of said member relative to said housing.

The present invention also relates to a lock as set forth in either of the two preceding paragraphs including a key for actuating said lock, and key-retaining means for retaining said key in engagement with said lock housing when said lock bolt is in an unlocking position and for permitting separation of said key and said lock housing when said lock bolt is in a locking position.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 1 is a fragmentary side elevational view of a cabinet having the improved lock of the present invention mounted on the door thereof;

FIG. 2 is a fragmentary end elevational view taken substantially in the direction of arrows 2—2 of FIG. 1;

FIG. 3 is an end elevational view taken substantially in the direction of arrows 3—3 of FIG. 1;

FIG. 4 is a fragmentary cross sectional view taken substantially along line 4—4 of FIG. 3 and showing the flag of the lock in locking position;

FIG. 7A is a cross sectional view taken substantially along line 7A—7A of FIG. 6;

FIG. 8 is an enlarged fragmentary cross sectional view taken substantially along line 8—8 of FIG. 5 but showing the lock in assembled condition and in locking relationship with its holding bracket;

FIG. 9 is a fragmentary cross sectional view taken substantially along line 9—9 of FIG. 8 and showing the retaining bracket which retains the key in locked relationship with the door of the cabinet when the flag is in a door opening position;

FIG. 10 is a fragmentary cross sectional view taken substantially along line 10—10 of FIG. 9 and showing only the key retaining b and its associated door;

FIG. 11 is a fragmentary end elevational view taken substantially in the direction of arrows 11—11 of FIG. 8 and showing the locknut for retaining the various lock parts in assembled condition on the bolt of the lock;

FIG. 12 is a perspective view of the lock housing;

FIG. 13 is an end elevational view of the lock housing taken substantially in the direction of arrows 13—13 of FIG. 12;

FIG. 14 is a side elevational view of the lock housing taken substantially in the direction of arrows 14—14 of FIG. 13;

FIG. 15 is perspective view of the torque plate;

FIG. 16 is an end elevational view of the torque plate taken substantially in the direction of arrows 16—16 of FIG. 15;

FIG. 17 is a side elevational view of the torque plate taken substantially in the direction of arrows 17—17 of FIG. 16;

FIG. 18 is a schematic view taken substantially in the direction of arrows 18—18 of FIG. 8 showing the torque plate superimposed over the end of the lock housing;

FIG. 19 is an enlarged side elevational view of the lock bolt;

FIG. 20 is an end elevational view of the lock bolt taken substantially in the direction of arrows 20—20 of FIG. 19;

FIG. 21 is an enlarged view of the spring of the lock;

FIG. 22 is a perspective view showing the rear portion of another embodiment of a housing which can replace the housing and key retaining bracket of the preceding figures;

FIG. 23 is a perspective view showing the front portion of the housing of FIG. 22;

FIG. 24 is a front elevational view of the housing taken substantially in the direction of arrows 24—24 of FIG. 23;

FIG. 24A is a fragmentary cross sectional view taken substantially along line 24A—24A of FIG. 24;

FIG. 25 is a perspective view of another embodiment of a torque plate which is to be used with the housing of FIGS. 22–24;

FIG. 26 is a front elevational view of the torque plate taken substantially in the direction of arrows 26—26 of FIG. 25;

FIG 27 is a perspective view of a key which is to be used with the housing of FIGS. 22–24;

FIG. 28 is an end view of the key taken substantially in the direction of arrows 28—28 of FIG. 27 and rotated 180° about the longitudinal axis of the key; and FIG. 29 is a fragmentary plan view of the key taken substantially in the direction of arrows 29—29 of FIG. 28.

DETAILED DESCRIPTION OF THE INVENTION

Figure 5:
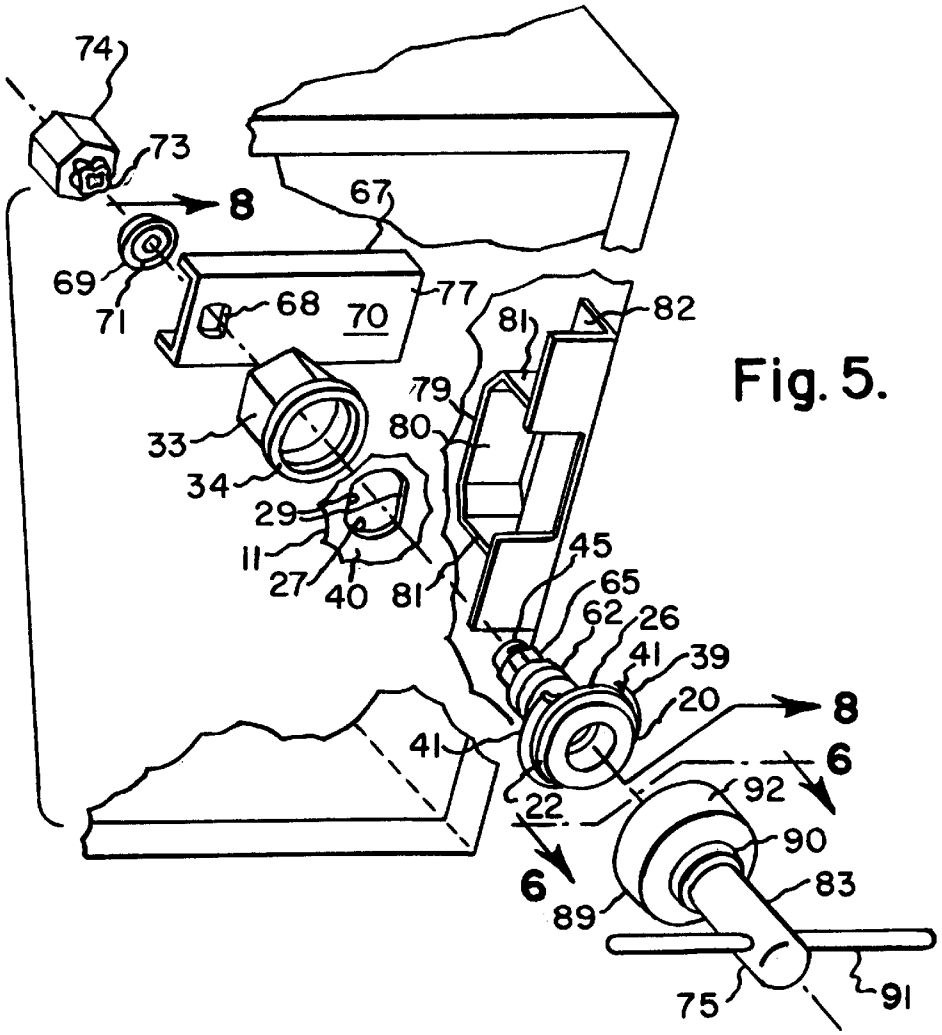
FIG. 5 is a fragmentary exploded perspective view of the improved lock, the key therefor, and the portion of the cabinet having the holding bracket thereon.

The lock 10 of the present invention is shown mounted on the door 11 of cabinet 12, door 11 being attached to end wall 13 by hinges 14. The cabinet also includes an end wall 15, side walls 17 and 19, and a rear wall (not shown). The cabinet 12 is intended to be an electric utility cabinet but may be of any desired type.

The lock 10 includes a lock housing 20 which has an annular lip 21 which includes a cylindrical portion 26 and an adjacent beveled edge 22. Lock housing 20 also includes a stem 23 which includes diametrically opposed flats 24 and diametrically opposed threaded portions 25. The stem 23 fits into a double-D aperture 27 (FIGS. 5, 8 and 9) in door 11, with the sides 29 of the double-D aperture lying adjacent portions 30 (FIGS. 8, 9, 12 and 14) of flats 24. Portions 30 are adjacent the rear face 31 of lip 21 and are diametrically opposed to each other between curved unthreaded portions 32. The portions 30 and 32 of stem 23 fit into complementary mating relationship with double-D aperture 27 so that lock housing 20 cannot rotate relative to door 11.

The lock housing 20 is secured on door 11 by jam nut 33 (FIGS. 5 and 8) which threads onto threads 25 of lock housing 20 and has annular end 34 which bears against the rear 35 of door 11. The flat annular portion 37 (FIGS. 9 and 10) of a key-retaining bracket 39 is clamped between the rear annular face 31 of lip 21 and the front surface 40 of door 11 with the diametrically opposed wings 41 of key-retaining bracket 39 being spaced from side 40 of door 11. The bracket 39 has a double-D aperture 42 (FIG. 9) with straight sides 43 between curved sides 44. The double-D aperture 42 fits in complementary mating relationship onto portions 30 and 32 of lock housing 20 so that the key-retaining bracket cannot rotate relative to lock housing 20 or to door 11.

A lock bolt 45 (FIGS. 8 and 19) is rotatably mounted within bore 47 (FIGS. 12 and 13) of lock housing 20. The lock bolt 45 includes a head 49 and a stem 50 which has diametrically opposed flats 51 and diametrically opposed threaded portions 52. The stem 50 also includes a cylindrical portion 53 which is rotatably received in cylindrical bore portion 54 (FIG. 14) of lock housing 20. The lock bolt 45 also includes a beveled annular shoulder 55 which bears against beveled annular shoulder 57 (FIG. 14) of lock housing 20 when lock bolt 45 is in its fully installed position within lock housing 20. As can be seen from FIG. 8, the head 49 of bolt 45 is recessed within lock housing 20 so that if an unauthorized tool is applied to groove 110 of bolt head 49, it has to have a low angle of attack relative to the bolt axis, which would be highly ineffectual for turning bolt 45.

When lock bolt 45 is in its fully installed position, a torque plate 59 (FIGS. 8, 15, 16, 17) is keyed to lock bolt 45. In this respect, the flats 60 (FIG. 16) of double-D aperture 58 of torque plate 59 are mounted adjacent the flats 51 of lock bolt 45 so that torque plate 59 will be keyed to pivot with lock bolt 45. A spring-type washer 61 is mounted on stem 50, and a washer 62 is also mounted on stem 50 on the opposite side of spring 61 from torque plate 59. Washer 62 has a groove 63 therein which receives an O-ring 64. A hex nut 65 threads onto stem 50 and bears against washer 62 which in turn bears against spring washer 61 which bears against torque plate 59. By adjusting the position of hex nut 65 on stem 50, the spring pressure of spring 61 against torque plate 59 may be adjusted to vary the torque required to turn bolt 45. The O-ring 64 seals the torque plate and the spring within the chamber of the jam nut 33, and the mating fit between the various parts of the lock themselves, and between the lock and the cabinet, and between the hole 68 of the flag and the bolt stem 51 effectively seal the lock against the environment to prolong its life.

A flag 67 (FIGS. 4, 5 and 8) has a double-D aperture 68 therein which fits in complementary mating relationship onto the stem 50 of lock bolt 45 so that flag 67 will turn with lock bolt 45. A lock nut 69 is threaded onto stem 50 and clamps the web portion 70 of flag 67 between the face 71 of lock nut 69 and the end of hex nut 65. Lock nut 69 has an irregular groove 72 (FIG. 11) therein which receives a mating irregular ridge 73 (FIG. 5) of key 74. The ridge and groove keying arrangement is well known in the art. Unless a ridge which mates with groove 72 is used, lock nut 69 cannot be turned. The purpose of using a lock nut 69 which requires a key, such as 74, is to prevent the lock 10 from being disassembled and removed from the door 11 by unauthorized persons.

Figure 7:
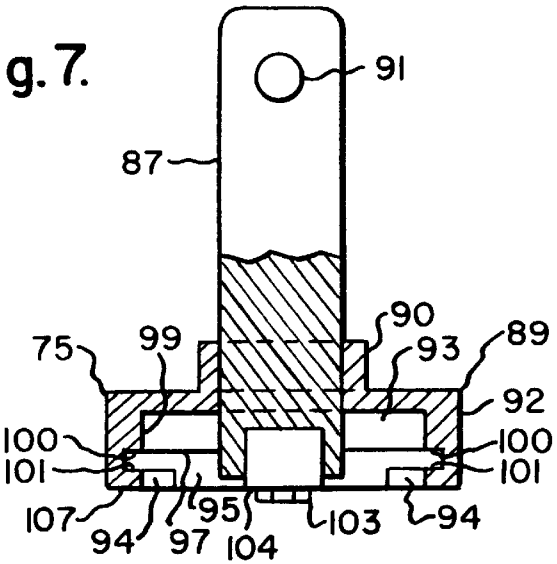
FIG. 7 is a fragmentary cross sectional view taken substantially along line 7—7 of FIG. 6.
Figure 6:
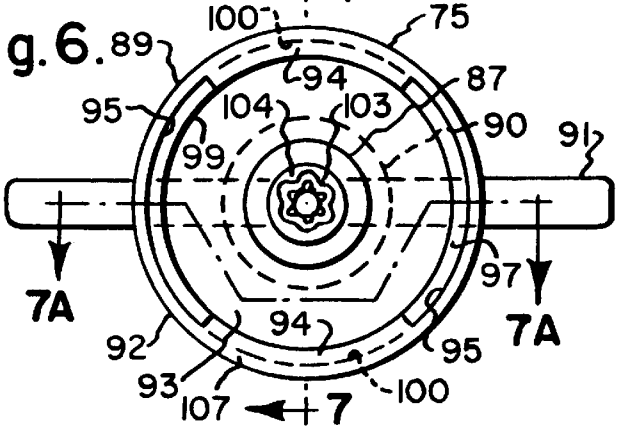
FIG. 6 is an enlarged end elevational view of the key of the present invention taken substantially in the direction of arrows 6—6 of FIG. 5.

A key 75 (FIGS. 5, 6 and 7) is utilized to actuate lock 10 to swing flag 67 between a locking position shown in FIG. 4 and an unlocking position wherein flag 67 is pivoted either clockwise or counterclockwise about 90° from its position shown in FIG. 4. In the locking position, the end 77 of flag 67 engages the rear side 79 (FIGS. 4 and 8) of bracket portion 80 which is essentially of U-shaped configuration having sides 81 (FIG. 8) which terminate at flanges 82 (FIGS. 4 and 8) which are adhesively secured to door 11 by double-sided adhesive pads 83, but may be secured by any other suitable means.

Key 75 includes a stem 87 (FIG. 7) onto which a cupped member 89 is nonrotatably secured at collar 90. A handle 91 is located at the end of stem 87. The cupped member 89 has a cylindrical side 92 which defines a chamber 93. A pair of wings 94 (FIGS. 6,7 and 7A) extend inwardly from the internal surface 95 which terminates at shoulder 97. The inner diameter across wings 94 is the same as the inner diameter at internal cylindrical surface 99. There are grooves 100 between the rear sides 101 of wings 94 and shoulder 97. Essentially the internal surfaces 95 between wings 94 are undercut relative to the internal diameter of surface 99. Additionally, the internal diameter across surfaces 95 is slightly larger than the outer diameter D (FIG. 10) across wings 41 of retaining bracket 39.

The internal diameter across wings 94 of key 75 is slightly larger than the external diameter of cylindrical portion 26 of lip 20. Therefore, the wings 94 of cup member 89 can slide over cylindrical surface 26 of lip 20 when they are located between wings 41 of bracket 39, and they can move inwardly across cylindrical surface 26. At this time, the curvilinear ridge 103 (FIGS. 6 and 7), which projects outwardly beyond the edge 107 of cup member 89, will be aligned with and will enter groove 110 (FIG. 9) in the head 49 of lock bolt 45. Thereafter, key 75 can be turned by applying a rotational force to handle 91 until such time as the wings 94 of cup member 85 pass into grooves 111 (FIGS. 9 and 10) between the wings 41 of bracket 39 and the surface portions 112 of door 11. The foregoing will lock key 75 to door 11, and the handle 91 of key 75 can be pulled to open door 11 because at this time the flag 67 will have been moved out of engagement with holding bracket 79.

Before key 75 is rotated, that is, in the locked condition of lock 10, the protrusions 113 on the undulating face 116 of torque plate 59 will be biased by spring 61 into the upper two depressions 114 (FIG. 13) on the undulating end 118 of lock housing 20. Additionally, the entire protrusions 115 including extensions 117 (FIGS. 15 and 16) will be received in the lower two depressions 114 (FIG. 13) in the end 118 of lock housing 20. As can be seen from FIG. 18, the upper two protrusions 113 of torque plate 59 occupy only an inner portion of depressions 114 in the end 118 of lock housing 20. Also, the torque plate protrusions 115, which include extensions 117, occupy the entire lower two depressions 114 in the end 118 of lock housing 20. As can be seen from FIG. 18 (wherein torque plate 59 is superimposed over end 118 of lock housing 20, and from a measurement on FIGS. 13 and 16) the diameter of the face of torque plate exclusive of extensions 117 is smaller than the diameter of the end 118 of lock housing 20.

When the foregoing engagement between torque plate 59 and lock housing 20 is effected, the inclined surfaces 120 of protrusions 113 will be in engagement with the inclined surfaces 121 which border the depressions 114 of lock housing 20 which receive the protrusions 113 of torque plate 59. Also, when the foregoing engagement is effected, the recesses 122 of torque plate 59 will receive the protrusions 123 of lock housing 20. In other words, the face 116 of torque plate 59 and the end 118 of lock housing 20 will be in complementary mating relationship.

When torque plate 59 is rotated relative to the end 118 of housing 120 during the turning of key 75, the inclined surfaces 120 of torque plate 59 have to cam outwardly relative to the inclined surfaces 121 of protrusions 123 on the end of housing 20. This requires the axial movement of torque plate 59 on stem 50 of lock bolt 45 to be against the bias of spring 61. Furthermore, after the turning motion has been effected, the protrusions 113 and the protrusions 115 will enter grooves 114 which are adjacent to the grooves in which they were previously located, and when they enter such adjacent grooves, they will be retained therein because of the bias exerted by spring 61. In this position the face 116 of the torque plate and the end 118 of lock housing 20 will be in complementary mating relationship.

When torque plate 59 is rotated in either direction to place the lock in an unlocked position, one of the upper two protrusions 113 on torque plate 59 will wipe across the face of protrusion 123' on end 118 of lock housing 20 without contacting the extension portion 129 of protrusion 123' because, as can be seen from FIG. 18, the extreme outer surface 113' of each protrusion 113 lies inwardly of extension portion 129 of protrusion 123'. However, there is cooperating structure between the torque plate 59 and the end 118 of housing 20 which limits movement of lock bolt 45 and flag 67 keyed thereto to positions approximately 90° in either direction from its locked position shown in FIG. 4. This structure is shown in FIGS. 13, 16 and 18 and it comprises the protrusion extensions 117 on torque plate 59 having shoulders 126 which engage the shoulders 128 of portion 129 of protrusion 123' on lock housing end 118. In the foregoing the shoulder 126 on extension 117 of a protrusion 115 will engage shoulder 128 of protrusion 123' to thereby prevent further movement. Thus, flag 67 cannot be rotated more than about 90° in either direction from its locked position.

It is to be noted that in both the locking position of torque plate 59, when it is in the position of FIGS. 16 and 18, and in the unlocking position of torque plate 59 when one of the two shoulders 126 engages a respective shoulder 128, the protrusions 113 and 115 on the torque plate are seated in the grooves 114 of the lock housing, and the protrusions 123 and 123' on the end 118 of the lock housing are seated in the grooves 122 of the torque plate. The torque which must be exerted on the key 75 to move the lock 10 between the above two positions, as noted above, depends on the adjustment of nut 65 which varies the compression of spring 61.

When it is desired to lock the cabinet door, it must first be closed and key 85 has to be rotated in a direction opposite to the direction which was used to move flag 67 away from its position of FIG. 4. This will cause the torque plate 59 to return to a position such as shown in FIG. 18 wherein extension portions 117 are at the bottom. At this time the wings 94 of key 75 will be out of grooves 111 (FIG. 10) and will be adjacent surfaces 109 between wings 41 of retaining bracket 39 so that the key 85 can be moved away from door 11.

In FIGS. 22–24 there is shown a lock housing 20' which can replace the lock housing 20 of FIGS. 12–14 and bracket 39 of FIGS. 9 and 10 when it is used in conjunction with the key 75' of FIG. 27 and the torque plate 59' of FIGS. 25–26. In FIGS. 22–27, the primed numerals correspond to the structure shown by the unprimed numerals in the preceding FIGS. 1–21 and designate analogous items of structure.

The lock housing 20' of FIGS. 22–24 is intended to replace the lock housing 20 of FIGS. 12–14 and the key-retaining bracket 39 of FIGS. 9 and 10. Lock housing 20' includes a cylindrical portion 26' and an adjacent beveled edge 22'. Lock housing 20' also includes a stem 23' which includes diametrically opposed flats 24' and diametrically opposed threaded portions 25'. The stem 23 fits into the double-D aperture 27 (FIGS. 5, 8 and 9) in door 11, with the sides 29 of the double-D aperture lying adjacent portions 30' of flats 24'. Portions 30' are adjacent the rear face 31' of lip 21' and are diametrically opposed to each other between curved unthreaded portions 32'. The portions 30' and 32' of stem 23' fit into complementary mating relationship with double-D aperture 27 so that lock housing 20' cannot rotate relative to door 11.

The undulating end 118' of lock housing 20' includes a plurality of depressions 114' which lie between protrusions 123'. All of the protrusions 123' are of equal configuration, and all of the depressions 114' are of equal configuration. Each of the protrusions 123' have inclined surfaces 121' on opposite sides thereof. It is to be noted that the uppermost protrusion 123' of FIG. 22 does not have the shoulders 128 of lock housing 20, as shown in FIG. 13.

Torque plate 59' is analogous to torque plate 59 of FIGS. 15–17 and it is used in an analogous manner. In this respect the undulating face 116' of torque plate 59' meshes with the undulating face 118' of lock housing 20'. More specifically, protrusions 113' in face 116' lie within depressions 114' in face 118' of lock housing 20'. It is to be noted that all protrusions 113' are of equal size, that is, the lower two protrusions 113' are not of the same configuration as protrusions 115 of FIG. 16 which have extensions 117 thereon. As can be seen from FIGS. 25 and 26, there are recesses 122' between protrusions 113'. As can be seen from FIGS. 25 and 26, protrusions 113' have inclined surfaces 120' on opposite sides thereof leading to recesses 122'. Also, as can be seen from FIG. 22, protrusions 123' have inclined surfaces 121' on opposite sides thereof leading to recesses 114'.

When the torque plate 59' is biased into engagement with the rear face 118' of housing 20' by spring 61, as described above relative to FIGS. 1–21, the protrusions 113' of torque plate 59' are located in the depressions 114' of housing 20', and the protrusions 123' of lock housing 20' are located in the recesses 122' of torque plate 59'. When the foregoing engagement between torque plate 59' and lock housing 20' is effected, the inclined surfaces 120' of protrusions 113' will be in engagement with the inclined surfaces 121' which border the depressions 114' of lock housing 20' which receive the protrusions 113' of torque plate 59'. In other words, the face 116' of torque plate 59' and the face 118' of lock housing 20' will be in complementary mating relationship.

Summarizing to this point, the torque plate 59' of FIGS. 25 and 26 does not have the extensions 117 and shoulders 126 of torque plate 59. Also, housing 20' does not have the shoulders 128 of housing 20.

The functions which were described above relative to shoulders 126 and shoulders 128 of torque plate 59 and housing 20, respectively, of FIGS. 1–21, are essentially replaced by the structure of key 75' (FIG. 27) in conjunction with the structure of housing 20'. In this respect, housing 20' has a lip or wing 135 which terminates at shoulders 137. Lip or wing 135 extends outwardly from surface 139 which includes surface portion 140 which lies behind lip 135. Thus, the rear surface of lip 135 is a shoulder 141 adjacent to surface portion 140. A shoulder 136 extends outwardly from surface portion 140, and shoulder 136 is parallel to shoulder 141. Thus, shoulders 136 and 141 define a groove 146 therebetween.

Key 75' includes a stem 87' having a curvilinear ridge 103' at the outer end thereof which is received in curvilinear groove 110 of the head 49 of lock bolt 45 (FIG. 9). Stem 87' has a ridge or wing 142 thereon which is received in the space 143 (FIGS. 23 and 24) between shoulders 137 of lip 135. In this respect, ridge or wing 142 terminates at shoulders 144 which are spaced apart a distance slightly less than the spacing of shoulders 137. Thus, in order for the end of key 75' to move axially past lip 135, shoulders 144 on ridge 142 must lie between shoulders 137 of lip 135. When this orientation occurs, ridge 103' on the end of key 75' will be in alignment with groove 110 of bolt 45. Also, after key 75' is moved axially and ridge 103' enters groove 110, the ridge 142 on key 75' will be aligned with groove 146 between shoulders 141 and 136. Therefore, when key 75' is turned to move flag 67 to an unlocking position, ridge 142 will enter the groove 146, and surface 145 of ridge 142 will lie adjacent to rear surface 141 of lip 135. Thus, in this position, key 75' cannot be withdrawn from engagement with lock housing 20' and therefore the handle 91' of key 75' will serve as a handle to open door 11. The limits of turning of key 75' are determined by protrusion 147 which projects outwardly from the rear surface of ridge 142. In this respect, protrusion 147 has shoulders 149 on the opposite sides thereof. When ridge 103' is in groove 110, shoulders 149 of protrusion 147 are circumferentially aligned with shoulders 137 of lip 135. Thus, when key 75' is turned, the limits of movement of key 75' in either direction are determined by shoulders 149 on opposite sides of protrusion 147 engaging the respective shoulders 137 at the ends of lip 135.

The spacing between shoulders 137 at the ends of lip 135 is such that when they are engaged by shoulders 149 of protrusion 147, the face 116' of torque plate 59' will be in fully seated relationship with the face 118' at the end of housing 20'. Also, when the key 75' is turned to a position where it can be withdrawn from housing 21', that is, when ridge 142 lies between shoulders 37 at the ends of lip 135, torque plate 59' will be turned to a position wherein face 116' thereof will be in complementary mating relationship with face 118' of housing 20'.

Aside from the above-described structure and mode of operation of the embodiment of FIGS. 22–29, the embodiment of FIGS. 22–29 operates in the same manner as described above relative to the embodiment of FIGS. 1–21.

While double-D shapes have been used to effect a keying relationship between various parts, it will be appreciated that other types of keying shapes or devices may be used. Also, while the undulating faces 116 and 118 of torque plate 59 and housing 20, respectively, have been shown as being integral therewith, it will be appreciated that other types of interacting undulating relationships or detents may also provide the desired results. It will also be appreciated that any other type of spring-biased interfitting engagement may be used between a member mounted on a lock bolt for rotation therewith and a lock housing for retaining the lock bolt in both a locking position and an unlocking position.

It can thus be seen that the lock arrangement of the present invention is manifestly capable of achieving the above-enumerated objects, and while preferred embodiments of the present invention have been disclosed, it will be appreciated that it is not limited thereto but may be otherwise embodied within the scope of the following claims.

What is claimed is:

1. A lock comprising a lock housing, a lock bolt rotatably mounted in said lock housing, an undulating end on said lock housing, a jam nut mounted on said lock housing, an end portion on said jam nut which extends beyond said undulating end of said lock housing and defines a chamber, a torque plate mounted on said lock bolt within said chamber for rotation with said lock bolt, an undulating face on said torque plate, a spring mounted on said lock bolt within said chamber, and a nut mounted on said lock bolt and effectively bearing against said spring for biasing said torque plate into engagement with said undulating end of said lock housing with said undulating face of said torque plate in meshing engagement with said undulating end of said lock housing.

2. A lock as set forth in claim 1 including a flag mounted on said lock bolt for rotation therewith.

3. A lock as set forth in claim 1 including a lock nut mounted on said lock bolt on the opposite side of said flag from said lock housing.

4. A lock as set forth in claim 1 wherein said lock bolt includes a head, and a key-receiving face on said head.

5. A lock as set forth in claim 4 wherein said key-receiving face is located within said lock housing.

6. A lock as set forth in claim 5 wherein said head includes a curvilinear groove in said key-receiving face.

7. A lock as set forth in claim 1 wherein said lock housing includes a threaded portion, and jam nut wherein said is mounted on said threaded portion.

8. A lock as set forth in claim 7 wherein said lock housing also includes a non-round portion.

9. A lock as set forth in claim 8 wherein said non-round portion comprises at least one flat on the side of said lock housing.

10. A lock as set forth in claim 1 wherein said lock housing includes a lip on the end thereof which is larger than said undulating end.

11. A lock as set forth in claim 10 wherein said lock housing also includes a threaded portion, and a jam nut mounted on said threaded portion.

12. A lock as set forth in claim 11 wherein said lock housing also includes a non-round portion.

13. A lock as set forth in claim 12 wherein said non-round portion comprises at least one flat on the side of said lock housing.

14. A lock as set forth in claim 10 including a flag mounted on said lock bolt for rotation therewith.

15. A lock as set forth in claim 14 including a lock nut mounted on said lock bolt on the opposite side of said flag from said lock housing.

16. A lock as set forth in claim 15 wherein said lock bolt includes a head, and a key-receiving face on said head.

17. A lock as set forth in claim 16 wherein said key-receiving face is located within said lock housing.

18. A lock as set forth in claim 17 wherein said head includes a curvilinear groove in said key-receiving face.

19. A lock as set forth in claim 18 wherein said lock housing includes a threaded portion, and jam nut wherein said is mounted on said threaded portion.

20. A lock as set forth in claim 19 wherein said lock housing also includes a non-round portion.

21. A lock as set forth in claim 20 wherein said non-round portion comprises at least one flat on the side of said lock housing.

22. A lock as set forth in claim 1 wherein said lock bolt includes a head, and a key-receiving face on said head in said lock housing, a threaded portion on said lock housing, and jam nut wherein said is mounted on said threaded portion.

23. A lock as set forth in claim 22 wherein said lock housing also includes a non-round portion.

24. A lock as set forth in claim 23 wherein said non-round portion comprises at least one flat on the side of said lock housing.

25. A lock as set forth in claim 24 wherein said lock housing includes a lip on the end thereof which is larger than said undulating end.

26. A lock as set forth in claim 22 wherein said lock housing includes a lip on the end thereof which is larger than said undulating end.

27. A lock as set forth in claim 1 including means for limiting rotational movement of said undulating face of said torque plate relative to said undulating end of said lock housing.

28. A lock as set forth in claim 27 wherein said means for limiting rotational movement comprise at least one first shoulder on said lock housing, and at least one second shoulder on said torque plate.

29. A lock as set forth in claim 27 including a key therefor wherein said means for limiting rotational movement comprise at least one first shoulder on said key, and at least one second shoulder on said housing.

30. A lock as set forth in claim 1 including a key therefor, a flag mounted on said lock bolt for rotation therewith and for movement between a first locking position and a second unlocking position, and key-retaining means for permitting separation of said key and said housing when said flag is in said first position and retaining said key relative to said housing when said flag is in said second position.

31. A lock and key therefor as set forth in claim 30 wherein said key-retaining means comprise a ridge on said key, and a lip on said housing.

32. A lock and key therefor as set forth in claim 30 wherein said key-retaining means comprise a first wing on said key, and a second wing on said housing.

33. A lock and key therefor as set forth in claim 31 wherein said second wing comprises a bracket mounted relative to said housing.

34. A lock and key therefor as set forth in claim 30 including means for limiting rotational movement of said undulating face of said torque plate relative to said undulating end of said lock housing.

35. A lock and key therefor as set forth in claim 34 wherein said means for limiting rotational movement comprises at least one first shoulder on said lock housing, and at least one second shoulder on said torque plate.

36. A lock and key therefor as set forth in claim 34 wherein said means for limiting rotational movement include at least one first shoulder on said key, and at least one second shoulder on said housing.

* * * * *

UNITED STATES PATENT AND TRADEMARK OFFICE

CERTIFICATE OF CORRECTION

PATENT NO. : 6,067,827

DATED : May 30, 2000 Sheet 1 of 2

INVENTOR(S) : Daryl R. Haseley et al

It is certified that error appears in the above-identified patent and that said Letters Patent is hereby corrected as shown below:

Column 2, line 41, after "retaining", change "b" to --bracket--.

Column 6, line 9, after "foregoing" insert --respect, if a protrusion 115 on torque plate 59 should attempt to wipe across protrusion 123' on the end of lock housing 20,--.

Column 8, line 53 (claim 1), after "housing" insert --, said torque plate and said spring being positioned protectively within said chamber provided by said jam nut--.

Column 8, line 56 (claim 3), change "1" to --2--.

Column 8, line 66 (claim 7), change "jam nut wherein said" to --wherein said jam nut--.

Column 9, line 10 (claim 11), change "a jam nut" to --wherein said jam nut is--.

Column 9, lines 29-30 (claim 19), change "jam nut wherein said" to --wherein said jam nut--.

UNITED STATES PATENT AND TRADEMARK OFFICE

CERTIFICATE OF CORRECTION

PATENT NO. : 6,067,827

DATED : May 30, 2000

INVENTOR(S) : Daryl R. Haseley et al

Sheet 2 of 2

It is certified that error appears in the above-identified patent and that said Letters Patent is hereby corrected as shown below:

Column 9, line 39 (claim 22), change "jam nut wherein said" to --wherein said jam nut--.

Signed and Sealed this

Twenty-fourth Day of April, 2001

*Attest:*

*Attesting Officer*

Nicholas P. Godici

NICHOLAS P. GODICI

*Acting Director of the United States Patent and Trademark Office*